US008276400B2

(12) United States Patent
Sakae et al.

(10) Patent No.: US 8,276,400 B2
(45) Date of Patent: Oct. 2, 2012

(54) REFRIGERATION APPARATUS

(75) Inventors: Satoru Sakae, Osaka (JP); Kouichi Kita, Osaka (JP); Hiroto Nakajima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1084 days.

(21) Appl. No.: 12/223,980

(22) PCT Filed: Feb. 20, 2007

(86) PCT No.: PCT/JP2007/053057

§ 371 (c)(1),
(2), (4) Date: Aug. 14, 2008

(87) PCT Pub. No.: WO2007/097311

PCT Pub. Date: Aug. 30, 2007

(65) Prior Publication Data

US 2010/0154465 A1 Jun. 24, 2010

(30) Foreign Application Priority Data

Feb. 20, 2006 (JP) ..... 2006-042854

(51) Int. Cl.
*F25B 43/02* (2006.01)

(52) U.S. Cl. ..... 62/470; 62/510

(58) Field of Classification Search ..... 62/470, 62/468, 510, 192, 193
See application file for complete search history.

(56) References Cited

U.S. PATENT DOCUMENTS 3,766,745 A * 10/1973 Quick ..... 62/196.2
4,589,263 A * 5/1986 DiCarlo et al. ..... 62/193
4,621,505 A * 11/1986 Ares et al. ..... 62/509
5,361,595 A * 11/1994 Shimura et al. ..... 62/175
5,522,233 A * 6/1996 Nares et al. ..... 62/193
5,673,570 A * 10/1997 Sada ..... 62/468
6,698,217 B2 * 3/2004 Tanimoto et al. ..... 62/175
6,722,156 B2 * 4/2004 Tanimoto et al. ..... 62/510
6,883,346 B2 * 4/2005 Tanimoto et al. ..... 62/510
6,938,430 B2 * 9/2005 Tanimoto et al. ..... 62/196.2
6,986,259 B2 * 1/2006 Takegami et al. ..... 62/84
7,028,502 B2 * 4/2006 Takegami et al. ..... 62/324.6
7,155,928 B2 * 1/2007 Takegami et al. ..... 62/498
7,305,846 B2 * 12/2007 Ueno et al. ..... 62/278
2005/0150246 A1 * 7/2005 Takegami et al. ..... 62/470

FOREIGN PATENT DOCUMENTS

JP 4-365993 A 12/1992
JP 7-260263 A 10/1995
JP 7-301465 A 11/1995
JP 2004-353996 A 12/2004
TW I242630 11/2005
WO WO-02/46663 A1 6/2002

* cited by examiner

*Primary Examiner* — Mohammad Ali

(74) *Attorney, Agent, or Firm* — Birch, Stewart, Kolasch & Birch, LLP

(57) ABSTRACT

For the supply of refrigeration oil accumulated in an oil return compressor (90*a*) into a higher stage compression mechanism (11), an oil sump in a discharge pressure space defined in the casing of the oil return compressor (90*a*) and the downstream side of an oil separator (94) are connected together through an oil return passageway (97). And, a pressure reducing means (93) for the reduction in pressure of refrigerant flowing towards the oil separator (94) from the oil return compression mechanism (90*a*) is disposed in place between the oil return compressor (90*a*) and the oil separator (94) in a discharge pipe (85) of a lower stage compression mechanism (90).

5 Claims, 2 Drawing Sheets

REFRIGERATION APPARATUS

TECHNICAL FIELD

The present invention relates generally to a refrigeration apparatus including a refrigerant circuit in which a lower stage compression mechanism and a higher stage compression mechanism are connected together in series to perform a two-stage compression refrigeration cycle. In particular, this invention relates to a mechanism for returning refrigeration oil back to the higher stage compression mechanism from the lower stage compression mechanism.

BACKGROUND ART

Generally, the conventional type of refrigeration apparatus performs a vapor compression refrigeration cycle by circulating refrigerant in a refrigerant circuit. As such a type of refrigeration apparatus, one that performs a two-stage compression refrigeration cycle (i.e., the stage of compression of refrigerant is divided into two phases) has been known in the past.

The refrigeration apparatus of the two-stage compression refrigeration cycle type is provided with a lower stage compression mechanism and a higher stage compression mechanism. Gas refrigerant of low pressure from an evaporator is drawn into a compressor of the lower stage compression mechanism where the low-pressure gas refrigerant is compressed to an intermediate level of pressure. The refrigerant discharged from the lower stage compression mechanism is delivered to a compressor of the higher stage compression mechanism where the refrigerant is compressed to a further extent. And, the refrigerant discharged from the higher stage compression mechanism is delivered to a condenser.

However, such a type of refrigeration apparatus requires some arrangement (for example, such as the provision of an oil separator or an oil return passageway) in order that there may be no lack of refrigeration oil in the compressor of the higher stage compression mechanism as well as in the compressor of the lower stage compression mechanism. For example, Patent Document 1 discloses that an oil separator is provided for the separation of refrigeration oil from refrigerant discharged from the higher stage compression mechanism, and in addition, an oil return passageway is provided through which to return the separated refrigeration oil back to each of the higher and the lower stage compression mechanisms from the oil separator. In addition, Patent Document 2 discloses that a gas-liquid separator is provided for the separation of refrigeration oil from refrigerant discharged from the lower stage compression mechanism, and in addition, an oil return passageway is provided through which to return the separated refrigeration oil back to the lower stage compression mechanism from the gas-liquid separator.

Patent Document 1: JP-A-H07-260263

Patent Document 2: WO 02/46663

DISCLOSURE OF THE INVENTION

Problems that the Invention Intends to Overcome

However, it is impossible for a conventional type of refrigeration apparatus to return the refrigeration oil accumulated in the compressor of the lower stage compression mechanism back to the higher stage compression mechanism. Consequently, refrigeration oil tends to accumulate on the low-pressure side, and as a result, the amount of refrigeration oil in the compressor of the higher stage compression mechanism will gradually decrease. This gives rise to the possibility that the compressor of the higher stage compression mechanism might break down because of burnout due to the lack of refrigeration oil.

The present invention was made in view of this point. Accordingly, an object of the present invention is to suppress, in a refrigeration apparatus in which a lower stage compression mechanism and a higher stage compression mechanism are connected together in series to perform a two-stage compression refrigeration cycle, the occurrence of breakdown in the compressor of the higher stage compression mechanism by circulating refrigeration oil throughout the compressor of the higher stage compression mechanism.

Means for Overcoming the Problem

The present invention provides, as a first aspect, a refrigeration apparatus (1) which includes: a refrigerant circuit (6) having a higher stage compression mechanism (11) formed of one or more compressors and a lower stage compression mechanism (90) formed of one or more compressors wherein the higher stage compression mechanism (11) and the lower stage compression mechanism (90) are connected together in series to perform a two-stage compression refrigeration cycle, and an oil separator (94), disposed in a discharge pipe (85) of the lower stage compression mechanism (90) in the refrigerant circuit (6), for separating refrigeration oil from refrigerant discharged from the lower stage compression mechanism (90).

Firstly, the refrigeration apparatus (1) includes an oil return passageway (97), the oil return passageway (97) extending from a compressor (90*a*) which constitutes the lower stage compression mechanism (90) for connection to a downstream side of the oil separator (94) whereby refrigeration oil accumulated in the compressor (90*a*) can be supplied to the higher stage compression mechanism (11). Secondarily, in the oil return compressor (90*a*) as a compressor to which the oil return passageway (97) is connected, a discharge pressure space filled with refrigerant after compression is formed in a casing thereof, and the oil return passageway (97) opens into an oil sump in the discharge pressure space. Thirdly, a pressure reducing means (93) for reducing the pressure of refrigerant flowing towards the oil separator (94) from the oil return compressor (90*a*) is disposed between the oil return compressor (90*a*) and the oil separator (94) in the discharge pipe (85) of the lower stage compression mechanism (90).

The present invention provides, as a second aspect according to the aforesaid first aspect, a refrigeration apparatus in which the lower stage compression mechanism (90) is formed of a plurality of compressors (90*a*, 90*b*, 90*c*) connected in parallel with one another, and the pressure reducing means (93) is disposed in a branched pipe (91*a*) of the discharge pipe (85) of the lower stage compression mechanism (90), the branched pipe (91*a*) being connected to the oil return compressor (90*a*).

The present invention provides, as a third aspect according to the aforesaid second aspect, a refrigeration apparatus in which the lower stage compression mechanism (90) is provided with an oil feed passageway (100, 101) through which to supply to a suction side of the oil return compressor (90*a*) refrigeration oil accumulated in the regular compressors (90*b*, 90*c*) other than the oil return compressor (90*a*).

The present invention provides, as a fourth aspect according to any one of the aforesaid first, second, and third aspects, a refrigeration apparatus in which the pressure reducing means (93) is formed by a control valve (93) with a controllable degree of opening, and a control means (30) is provided which enables, by control that reduces the degree of opening of the control valve (93) to thereby widen the difference in pressure between the discharge pressure space of the oil return compressor (90*a*) and the downstream side of the oil separator (94), the execution of an oil return operation in which refrigeration oil accumulated in the oil sump of the discharge pressure space is fed into the higher stage compression mechanism (11) by way of the oil return passageway (97).

The present invention provides, as a fifth aspect according to the aforesaid fourth aspect, a refrigeration apparatus in which the oil return compressor (90*a*) is configured to be variable in operation capacity, and the control means (30) is so configured as to enable the execution of the oil return operation if the operation capacity of the oil return compressor (90*a*) falls below a predefined value.

Operation

In the first aspect of the present invention, the oil return passageway (97) used for the supply of refrigeration oil accumulated in the oil return compressor (90*a*) to the higher stage compression mechanism (11) establishes connection between the oil sump of the discharge pressure space defined in the casing of the oil return compressor (90*a*) and the downstream side of the oil separator (94). Here, if the pressure reducing means (93) reduces the pressure of refrigerant flowing towards the oil separator (94) from the oil return compressor (90*a*), this widens the difference in pressure between the discharge pressure space in the casing of the oil return compressor (90*a*) and the downstream side of the oil separator (94). That is, the difference in pressure between the inlet end of the high pressure side and the outlet end of the low pressure side in the oil return passageway (97) widens. This consequently facilitates the flow of refrigeration oil in the oil sump of the discharge pressure space from the downstream side of the oil separator (94) to the higher stage compression mechanism (11) via the oil return passageway (97).

In the second aspect of the present invention, the pressure reducing means (93) is disposed in the branched pipe (91*a*) of the discharge pipe (85) of the lower stage compression mechanism (90), the branched pipe (91*a*) being connected to the oil return compressor (90*a*). Therefore, the refrigerant discharged from each of the compressors (90*b*, 90*c*) other than the oil return compressor (90*a*) in the lower stage compression mechanism (90) flows into the oil separator (94), without passing through the pressure reducing means (93).

In the third aspect of the present invention, the refrigeration oil accumulated in the regular compressor (90*b*, 90*c*) in the lower stage compression mechanism (90) is supplied through the oil feed passageway (100,101) to the suction side of the oil return compressor (90*a*). That is, the refrigeration oil in each of the compressors (90*a*, 90*b*, 90*c*) of the lower stage compression mechanism (90) is brought together in the oil return compressor (90*a*).

In the fourth aspect of the present invention, if the degree of opening of the control valve (93) as a pressure reducing means is decreased, this increases the resistance to passage of the discharge pipe (85). Consequently, the pressure in the oil return compressor (90*a*) increases, and in addition, the discharged refrigerant from the oil return compressor (90*a*) is pressure reduced during its passage through the control valve (93). This widens the difference in pressure between the discharge pressure space in the casing of the oil return compressor (90*a*) and the downstream side of the oil separator (94). In the fourth aspect of the present invention, the control means (30) is provided which controls the degree of opening of the control valve (93). The difference in pressure between the discharge pressure space in the casing of the oil return compressor (90*a*) and the downstream side of the oil separator (94) is regulated by controlling the degree of opening of the control valve (93), whereby the flowability of refrigeration oil from the oil return compressor (90*a*) to the higher stage compression mechanism (11) is regulated.

In the fifth aspect of the present invention, if the operation capacity of the oil return compressor (90*a*) whose operation capacity is variable falls below a predefined value, this results in the execution of an oil return operation. Since the pressure of the discharge pressure space in the oil compressor (90*a*) drops if the operation capacity of the oil return compressor (90*a*) is being small, the difference in pressure between the discharge pressure space in the casing of the oil return compressor (90*a*) and the downstream side of the oil separator (94) becomes narrowed. In other words, the flow of refrigeration oil from the oil return compressor (90*a*) to the higher stage compression mechanism (11) becomes impeded. To cope with such a case, an oil return operation is carried out to thereby widen the difference in pressure between the discharge pressure space in the casing of the oil return compressor (90*a*) and the downstream side of the oil separator (94).

Working Effect of the Invention

In the present invention, the pressure reducing means (93) reduces the pressure of refrigerant flowing towards the oil separator (94) from the oil return compressor (90*a*), thereby widening the pressure difference for the feed of refrigeration oil from the oil return compressor (90*a*) to the higher stage compression mechanism (11). That is, by the pressure reducing means (93), it becomes possible to facilitate the flow of refrigeration oil (which is likely to accumulate on the side of the lower stage compression mechanism (90) of lower pressure) from the oil return compressor (90*a*) to the higher stage compression mechanism (11). This facilitates the distribution of refrigeration oil to the higher stage compression mechanism (11), thereby making it possible to suppress not only the lack of refrigeration oil in the compressor (11*a*, 11*b*) of the higher stage compression mechanism (11) but also the occurrence of breakdown because of such a lack of refrigeration oil. Besides, it is possible to suppress an excessive accumulation of refrigeration oil in the oil return compressor (90*a*). This makes it possible to reduce the resistance to rotation caused by refrigeration oil in the oil return compressor (90*a*), thus resulting in improved operation efficiency.

In addition, in accordance with the present invention, it is also possible to lubricate the compressor (11*a*, 11*b*) of the higher stage compression mechanism (11) and the compressor (90*a*, 90*b*, 90*c*) of the lower stage compression mechanism (90) with much less amounts of refrigeration oil. In this case, since the rotational resistance, caused by refrigeration oil in the compressor (11*a*, 11*b*) of the higher stage compression mechanism (11) and the compressor (90*a*, 90*b*, 90*c*) of the lower stage compression mechanism (90), is reduced, the operation efficiency of the refrigeration apparatus (1) can be enhanced.

In the second aspect of the present invention, the discharged refrigerant from the compressor (90*b*, 90*c*) other than the oil return compressor (90*a*) in the lower stage compression mechanism (90) flows into the oil separator (94), without passing through the pressure reducing means (93). In other words, since the discharged refrigerant from the compressor (90*b*, 90*c*) other than the oil return compressor (90*a*) in the lower stage compression mechanism (90) is free from any pressure loss caused by the pressure reducing means (93), this makes it possible to reduce the loss of pressure of the refrigerant in the lower stage compression mechanism (90) when compared with the case where the pressure reducing means (93) is disposed in a position located after the point at which each branched pipe (91*a*, 91*b*, 91*c*) in the discharge pipe (85) of the lower stage compression mechanism (90) joins the others. Therefore, the reduction in the efficiency of operation of the lower stage compression mechanism (90) due to the provision of the pressure reducing means (93) can be suppressed.

In the third aspect of the present invention, by the provision of the oil feed passageway (100,101), the refrigeration oil in each compressor (90*a*, 90*b*, 90*c*) of the lower stage compression mechanism (90) is brought together in the oil return compressor (90*a*). Therefore, much larger amounts of refrigeration oil can be fed to the higher stage compression mechanism (11), thereby making it possible to suppress not only the lack of refrigeration oil in the compressor (11*a*, 11*b*) of the higher stage compression mechanism (11) but also the occurrence of breakdown because of such a lack of refrigeration oil. Besides, it is possible to suppress an excessive accumulation of refrigeration oil in the regular compressor (90*b*, 90*c*). This makes it possible to reduce, in the regular compressor (90*b*, 90*c*), the resistance to rotation caused by refrigeration oil, thus resulting in improved operation efficiency.

In the fourth aspect of the present invention, by the provision of the control means (30) which regulates the control valve (93) so that an oil return operation is executed, the flowability of refrigeration oil from the oil return compressor (90*a*) to the higher stage compression mechanism (11) is regulated. Therefore, it becomes possible for the control means (30) to regulate the balance between the amount of refrigeration oil in the lower stage compression mechanism (90) and the amount of refrigeration oil in the higher stage compression mechanism (11), whereby refrigeration oil can be appropriately distributed to the compressor (90*a*, 90*b*, 90*c*) of the lower stage compression mechanism (90) as well as to the compressor (11*a*, 11*b*) of the higher stage compression mechanism (11).

In the fifth aspect of the present invention, the control means (30) enables the execution of an oil return operation, when the operation capacity of the oil return compressor (90*a*) becomes decreased thereby impeding the flow of refrigeration oil into the higher stage compression mechanism (11) from the oil return compressor (90*a*). That is, regardless of the operation capacity of the oil return compressor (90*a*), refrigeration oil can be stably supplied to the higher stage compression mechanism (11) from the oil return compressor (90*a*). Therefore, it becomes possible to not only suppress the lack of refrigeration oil in the higher stage compression mechanism (11) to a further extent but also prevent refrigeration oil from excessively accumulating in the oil return compressor (90*a*).

REFERENCE NUMERALS IN THE DRAWINGS

Figure 1:
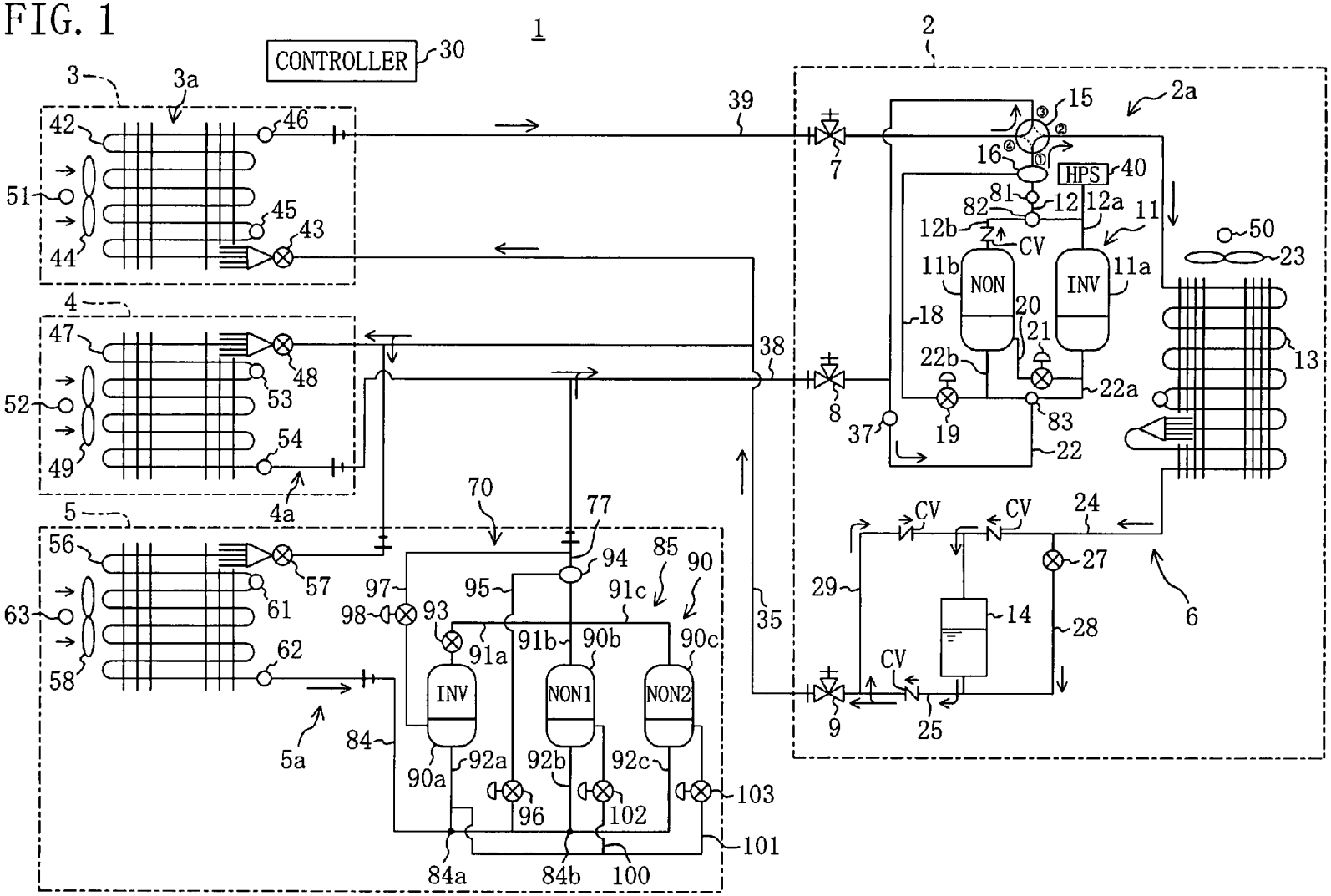
FIG. 1 is a schematic block diagram of a refrigeration apparatus according to an embodiment of the present invention.

1 refrigeration apparatus
6 refrigerant circuit
11 higher stage compression mechanism
30 controller (control means)
85 discharge pipe
90 lower stage compression mechanism
90*a* first lower stage compressor (oil return compressor)
90*b* second lower stage compressor (regular compressor)
90*c* third lower stage compressor (regular compressor)
91*a* first branched pipe (branched pipe)
93 control valve (pressure reducing means)
94 oil separator
97 oil return pipe (oil return passageway)
100 oil feed pipe (oil feed passageway)
101 oil feed pipe (oil feed passageway)

BEST MODE FOR CARRYING OUT THE INVENTION

With reference to the drawings, embodiments of the present invention will be described below.

Overall Configuration of the Refrigeration Apparatus

A refrigeration apparatus (1) according to an embodiment of the present invention is one of the type that provides indoor air-conditioning and cold/freeze storage of food and drink. The refrigeration apparatus (1) is installed, for example, in a convenience store. As shown in FIG. 1, the refrigeration apparatus (1) is equipped with a refrigerant circuit (6) in which a higher stage compression mechanism (11) and a lower stage compression mechanism (90) are connected together in series to perform a two-stage compression refrigeration cycle. The refrigerant circuit (6) includes an outdoor circuit (2*a*) for an outdoor unit (2), an indoor circuit (3*a*) for an indoor unit (3), a cold-storage circuit (4*a*) for a cold-storage unit (4), and a freeze-storage circuit (5*a*) for a freeze-storage unit (5).

A first closing valve (7), a second closing valve (8), and a third closing valve (9) are each disposed at a respective end of the outdoor circuit (2*a*). One end of a first gas side interunit pipe line (39) is connected to the first closing valve (7). The other end of the first gas side interunit pipe line (39) is connected to a gas side end of the indoor circuit (3*a*). One end of a second gas side interunit pipe line (38) is connected to the second closing valve (8). The other end of the second gas side interunit pipe line (38) splits into two branches one of which is connected to a gas side end of the cold-storage circuit (4*a*) and the other of which is connected to a gas side end of the freeze-storage circuit (5*a*). One end of a liquid side interunit pipe line (35) is connected to the third closing valve (9). The other end of the liquid side interunit pipe line (35) splits into three branches, the first of which is connected to a liquid side end of the indoor circuit (3*a*), the second of which is connected to a liquid side end of the cold-storage circuit (4*a*), and the third of which is connected to a liquid side end of the freeze-storage circuit (5*a*).

Outdoor Unit

The outdoor circuit (2*a*) is provided with a higher stage compression mechanism (11), an outdoor heat exchanger (13), a receiver (14), and an oil separator (16). The higher stage compression mechanism (11) is made up of a first higher stage compressor (11*a*) of variable capacity and a second higher stage compressor (11*b*) of fixed capacity. The first higher stage compressor (11*a*) and the second higher stage compressor (11*b*) are connected in parallel with each other. The first higher stage compressor (11*a*) is configured such that its operation capacity can be varied. The first higher stage compressor (11*a*) is supplied with electric power through an inverter. That is, the output frequency of the inverter is varied to thereby change the drive motor's rotational speed, whereby the capacity of the first higher stage compressor (11*a*) can be changed. On the other hand, the operation capacity of the second higher stage compressor (11*b*) is fixed and the drive motor thereof is operated constantly at a fixed rotational speed.

One end of a first discharge pipe (12*a*) is connected to the discharge side of the first higher stage compressor (11*a*). One end of a second discharge pipe (12*b*) is connected to the discharge side of the second higher stage compressor (11*b*). The other end of each of the discharge pipes (12*a*, 12*b*) is connected to a first port of a four-way selector valve (15) through a discharge side main pipe (12). In addition, the second discharge pipe (12*b*) is provided with a check valve (CV) which permits only the flow of refrigerant from the second higher stage compressor (11*b*) towards the discharge side main pipe (12).

One end of a first suction pipe (22*a*) is connected to the suction side of the first higher stage compressor (11*a*). One end of a second suction pipe (22*b*) is connected to the suction side of the second higher stage compressor (11*b*). The suction pipes (22*a*, 22*b*) are branched pipes from one end of a suction side main pipe (22). The other end of the suction side main pipe (22) splits into two branches one of which is connected to a third port of the four-way selector valve (15) and the other of which is connected to the second closing valve (8). In addition, the first closing valve (7) is connected to a fourth port of the four-way selector valve (15).

An oil separator (16) is disposed in the discharge side main pipe (12). The oil separator (16) is used for the separation of refrigeration oil from refrigerant discharged from the higher stage compressors (11*a*, 11*b*). One end of an oil return pipe (18) is connected to the oil separator (16). The other end of the oil return pipe (18) is connected to the second suction pipe (22*b*). The oil return pipe (18) is provided with an oil return solenoid valve (19). When the oil return solenoid valve (19) is placed in the opened state, refrigeration oil in the oil separator (16) is returned back to the higher stage compression mechanism (11).

Connected to the second higher stage compressor (11*b*) is an oil equalizing pipe (20) one end of which is connected to the first suction pipe (22*a*). The oil equalizing pipe (20) is provided with an oil equalizing solenoid valve (21). When the oil equalizing solenoid valve (21) is placed in the opened state, refrigeration oil in the second higher stage compressor (11*b*) is fed into the first higher stage compressor (11*a*).

The outdoor heat exchanger (13) is implemented by a fin and tube heat exchanger of the cross fin type, and it constitutes a heat exchanger on the heat source side. Disposed in the vicinity of the outdoor heat exchanger (13) is an outdoor fan (23). In the outdoor heat exchanger (13), the exchange of heat takes place between the circulating refrigerant and the outdoor air sent by the outdoor fan (23). One end of the outdoor heat exchanger (13) is connected to a second port of the four-way selector valve (15).

The other end of the outdoor heat exchanger (13) is connected to the top of the receiver (14) via a first liquid pipe (24). The first liquid pipe (24) is provided with a check valve (CV) which permits only the flow of refrigerant in the direction of the receiver (14). The receiver (14) is connected to the third closing valve (9) via a second liquid pipe (25). The second liquid pipe (25) is provide with a check valve (CV) which permits only the flow of refrigerant in the direction of the third closing valve (9).

Disposed between the first liquid pipe (24) and the second liquid pipe (25) are a first bypass pipe (28) and a second bypass pipe (29) both of which bypass the receiver (14). One end of the first bypass pipe (28) is connected to between the outdoor heat exchanger (13) and the check valve (CV) in the first liquid pipe (24). The other end of the first bypass pipe (28) is connected to between the receiver (14) and the check valve (CV) in the second liquid pipe (25). The first bypass pipe (28) is provided with an electronic expansion valve (27). One end of the second bypass pipe (29) is connected to between the check valve (CV) and the receiver (14) in the first liquid pipe (24). The other end of the second bypass pipe (29) is connected to between the check valve (CV) and the third closing valves (9) in the second liquid pipe (25). The second bypass pipe (29) is provided with a check valve (CV) which permits only the flow of refrigerant in the direction of the receiver (14).

The four-way selector valve (15) is switchable between a first state (represented by solid line in FIG. 1) and a second state (broken line in FIG. 1). That is, when placed in the first state, the four-way selector valve (15) establishes fluid communication between the first port and the second port and fluid communication between the third port and the fourth port. On the other hand, when placed in the second state, the four-way selector valve (15) establishes fluid communication between the first port and the fourth port and fluid communication between the second port and the third port.

Sensors of different types and pressure switches of different types are arranged in the outdoor unit (2). More specifically, the first discharge pipe (12*a*) is provided with a high pressure switch (40). The high pressure switch (40) is configured such that it detects the discharge pressure of the higher stage compression mechanism (11). The high pressure switch (40) operates as a protective device that urgently brings the registration apparatus (1) to a stop upon the detection of an abnormally high pressure. A pressure sensor (82) is disposed at the point where the first discharge pipe (12*a*) and the second discharge pipe (12*b*) join together (i.e., the upstream end of the discharge side main pipe (12)). The discharge side main pipe (12) is provided with a temperature sensor (81). A pressure sensor (83) is disposed at the point where the first suction pipe (22*a*) and the second suction pipe (22*b*) join together (i.e., the downstream end of the suction side main pipe (22)). The suction side main pipe (22) is provided with a temperature sensor (37). In addition, a temperature sensor (50) for detecting the temperature of outdoor air is disposed in the vicinity of the outdoor fan (23).

Indoor Unit

The indoor unit (3) provides indoor air-conditioning. The indoor circuit (3*a*) of the indoor unit (3) is provided, sequentially in the direction from its liquid to gas side end, with an indoor expansion valve (43) and an indoor heat exchanger (42). The indoor expansion valve (43) is formed by an electronic expansion valve with a controllable degree of opening. In addition, the indoor heat exchanger (42) is formed by a fin and tube heat exchanger of the cross fin type. An indoor fan (44) is disposed in the vicinity of the indoor heat exchanger (42). In the indoor heat exchanger (42), the exchange of heat takes place between the circulating refrigerant and the indoor air sent by the indoor fan (44).

The indoor heat exchanger (42) is provided with a temperature sensor (45). A temperature sensor (46) is disposed between the gas side end of the indoor circuit (3*a*) and the indoor heat exchanger (42). In addition, a temperature sensor (51) for detecting the temperature of indoor air is disposed in the vicinity of the indoor fan (44).

Cold-Storage Unit

The cold-storage unit (4) provides cold storage of food and drink. The cold-storage circuit (4*a*) of the cold-storage unit (4) is provided, sequentially in the direction from its liquid to gas side end, with a cold-storage expansion valve (48) and a cold-storage heat exchanger (47). The cold-storage expansion valve (48) is formed by an electronic expansion valve with a controllable degree of opening. In addition, the cold-storage heat exchanger (47) is formed by a fin and tube heat exchanger of the cross fin type. A cold-storage fan (49) is disposed in the vicinity of the cold-storage heat exchanger (47). In the cold-storage heat exchanger (47), the exchange of heat takes place between the circulating refrigerant and the compartment air sent by the cold-storage fan (49).

The cold-storage heat exchanger (47) is provided with a temperature sensor (53). A temperature sensor (54) is disposed between the gas side end of the cold-storage circuit (4*a*) and the cold-storage heat exchanger (47). In addition, a temperature sensor (52) for detecting the temperature of compartment air is disposed in the vicinity of the cold-storage fan (49).

Freeze-Storage Unit

The freeze-storage unit (5) provides freeze-storage of food and drink. The freeze-storage circuit (5*a*) of the freeze-storage unit (5) is provided, sequentially in the direction from its liquid to gas side end, with a freeze-storage expansion valve (57), a freeze-storage heat exchanger (56), a lower stage compression mechanism (90), and an oil separator (94). The freeze-storage expansion valve (57) is formed by an electronic expansion valve with a controllable degree of opening. In addition, the freeze-storage heat exchanger (56) is formed by a fin and tube heat exchanger of the cross fin type. A freeze-storage fan (58) is disposed in the vicinity of the freeze-storage heat exchanger (56). In the freeze-storage heat exchanger (56), the exchange of heat takes place between the circulating refrigerant and the compartment air sent by the freeze-storage fan (58).

The freeze-storage heat exchanger (56) is provided with a temperature sensor (61). A temperature sensor (62) is disposed between the gas side end of the freeze-storage circuit (5*a*) and the freeze-storage heat exchanger (56). In addition, a temperature sensor (63) for detecting the temperature of compartment air is disposed in the vicinity of the freeze-storage fan (58).

The lower stage compression mechanism (90) is made up of a first lower stage compressor (90*a*) as an oil return compressor, a second lower stage compressor (90*b*) as a regular compressor, and a third lower stage compressor (90*c*) as another regular compressor. The first lower stage compressor (90*a*) is configured such that its operation capacity can be varied. The first lower stage compressor (90*a*) is supplied with electric power through an inverter. That is, the output frequency of the inverter is varied to thereby change the drive motor's rotational speed, whereby the operation capacity of the first lower stage compressor (90*a*) can be varied. On the other hand, the operation capacity of each of the second lower stage compressor (90*b*) and the third lower stage compressor (90*c*) is fixed and each of their drive motors is operated constantly at a fixed rotational speed.

The first lower stage compressor (90*a*), the second lower stage compressor (90*b*), and the third lower stage compressor (90*c*) are each formed into a high-pressure dome type, and there is defined in each of their casings a discharge pressure space filled with refrigerant after compression. In addition, an oil sump where refrigeration oil collects is formed at the bottom of the casing of each of the compressors (90*a*, 90*b*, 90*c*).

A discharge pipe (85) is connected to each of the compressors (90*a*, 90*b*, 90*c*) of the lower stage compression mechanism (90). The discharge pipe (85) includes a discharge side main pipe (77), a first branched pipe (91*a*), a second branched pipe (91*b*), and a third branched pipe (91*c*). One end of the first branched pipe (91*a*) is connected to the discharge side of the first lower stage compressor (90*a*). One end of the second branched pipe (91*b*) is connected to the discharge side of the second lower stage compressor (90*b*). One end of the third branched pipe (91*c*) is connected to the discharge side of the third lower stage compressor (90*c*). The other end of each of the branched pipes (91*a*, 91*b*, 91*c*) is connected to the second gas side interunit pipe line (38) via the discharge side main pipe (77).

The first branched pipe (91*a*) is provided with a control valve (93) which is a pressure reducing mechanism for reducing the pressure of refrigerant that passes therethrough. The control valve (93) is formed by an electronic expansion valve with a controllable degree of opening. The pressure reducing means (93) can be in any form as long as it becomes resistant to the flow and passage of refrigerant. Any suitable means other than the control valve (such as capillary tube, oil separator, filter, muffler, check valve, a long pipe line et cetera) may be available.

One end of a first suction pipe (92*a*) is connected to the suction side of the first lower stage compressor (90*a*). One end of a second suction pipe (92*b*) is connected to the suction side of the second lower stage compressor (90*b*). One end of a third suction pipe (92*c*) is connected to the third lower stage compressor (90*c*). The suction pipes (92*a*, 92*b*, 92*c*) are branched pipes from one end of the suction side main pipe (84) the other end of which is connected to the freeze-storage heat exchanger (56). More specifically, in the suction side main pipe (84), the first suction pipe (92*a*) is branched off at a first branch point (84*a*) on the upstream side and the second suction pipe (92*b*) and the third suction pipe (92*c*) are branched off at a second branch point (84*b*).

The discharge side main pipe (77) is provided with an oil separator (94). The oil separator (94) is for the separation of refrigeration oil from refrigerant discharged from each of the lower stage compressors (90*a*, 90*b*, 90*c*). One end of an oil return pipe (95) is connected to the oil separator (94). The other end of the oil return pipe (95) is connected to between the first branch point (84*a*) and the second branch point (84*b*) in the suction side main pipe (84).

The oil return pipe (95) is provided with an oil return solenoid valve (96). If the oil return solenoid valve (96) is placed in the opened state, then the refrigeration oil separated from the discharged refrigerant in the oil separator (94) flows into the suction side main pipe (84). The refrigeration oil flowed into the suction side main pipe (84) is drawn into the first lower stage compressor (90*a*) during the time that the second lower stage compressor (90*b*) and the third lower stage compressor (90*c*) are stopped. On the other hand, during the time that the second lower stage compressor (90*b*) or the third lower stage compressor (90*c*) is operated, the refrigeration oil is drawn into the second lower stage compressor (90*b*) or the third lower stage compressor (90*c*), whichever is in operation.

One end of an oil return pipe (97) as an oil return passageway is connected to the first lower stage compressor (90*a*). The one end of the oil return pipe (97) is opened to the oil sump in the casing of the first lower stage compressor (90*a*), and the other end thereof is connected to the downstream side of the oil separator (94) in the discharge side main pipe (77). The position at which the oil return pipe (97) opens into the casing of the first lower stage compressor (90*a*) is set to an oil level height corresponding to the accumulation of a required minimum amount of refrigeration oil for the lubrication of the compressor (90*a*). The oil return pipe (97) is provided with an oil return solenoid valve (98). If the degree of opening of the control valve (93) is regulated with the oil return solenoid valve (98) placed in the opened state, this results in the execution of an oil return operation. The details as to this oil return operation will be described later.

One ends of oil feed pipes (100,101) as oil feed passageways are opened, respectively, to the second lower stage compressor (90*b*) and to the third lower stage compressor (90*c*). The other ends of the oil feed pipes (100,101) join together and are connected to the first suction pipe (92*a*). The position at which the oil feed pipe (100,101) opens into the casing of the lower stage compressor (90*b*, 90*c*) is set to an oil level height corresponding to the accumulation of a required minimum amount of refrigeration oil for the lubrication of the lower stage compressor (90*b*, 90*c*).

The oil feed pipe (100,101) is provided with an oil feed solenoid valve (102,103). If the oil feed solenoid valve (102, 103) is placed in the opened state when the oil level of the oil sump in the lower stage compressor (90*b*, 90*c*) is higher than the opening position of the oil feed pipe (100,101), the refrigeration oil in the oil sump is drawn into the first lower stage compressor (90*a*) through the oil feed pipe (100,101) because the pressure in the lower stage compressor (90*b*, 90*c*) is higher than the pressure in the first suction pipe (92*a*). Consequently, the refrigeration oil of the lower stage compression mechanism (90) is collected in the first lower stage compressor (90*a*).

Running Operation of the Refrigeration Apparatus

Next, the running operation of the refrigeration apparatus (1) will be described.

The refrigeration apparatus (1) is provided with a controller (30). The controller (30) is capable of, in addition to providing switching between the cooling mode and the heating mode and power control of these modes, enabling the execution of an oil return operation to be hereinafter described. In the following description, the running operation of the refrigeration apparatus (1) during the cooling mode of operation is described. With respect to the running operation of the refrigeration apparatus (1) during the heating mode of operation, its description is omitted here.

During the cooling mode of operation, the controller (30) sets the four-way selector valve (15) in the first state, thereby establishing fluid communication between the first port and the second port and fluid communication between the third port and the fourth port. In addition, the electronic expansion valve (27) of the outdoor unit (2) is set in the fully closed state. And, when the higher stage compression mechanism (11) and the lower stage compression mechanism (90) are placed in operation by the controller (30), the refrigerant will circulate in a direction indicated by arrow in FIG. 1 in the refrigerant circuit (6).

More specifically, refrigerant discharged from the higher stage compression mechanism (11) is condensed in the outdoor heat exchanger (13), and then flows into the receiver (14). The refrigerant in the receiver (14) flows out from the outdoor unit (2). Thereafter, the refrigerant is diverged to flow into the indoor unit (3), into the cold-storage unit (4), and into the freeze-storage unit (5). Refrigerant flowed into the indoor unit (3) is pressure reduced by the indoor expansion valve (43) and then evaporated in the indoor heat exchanger (42), whereby indoor air is cooled. Refrigerant flowed into the cold-storage unit (4) is pressure reduced by the cold-storage expansion valve (48) down to a first predefined pressure PL1 and then evaporated in the cold-storage heat exchanger (47), whereby compartment air is cooled.

Meanwhile, refrigerant flowed into the freeze-storage unit (5) is pressure reduced by the freeze-storage expansion valve (57) down to a second predefined pressure PL2 lower than the first predefined pressure PL1. The refrigerant thus pressure reduced is evaporated in the freeze-storage heat exchanger (56), whereby compartment air is cooled. The refrigerant flowed out from the freeze-storage heat exchanger (56) is pressure increased by the lower stage compression mechanism (90) up to the first predefined pressure PL1, joins the refrigerant flowed out from the cold-storage heat exchanger (47), and flows into the outdoor unit (2). The refrigerant flowed into the outdoor unit (2) joins the refrigerant returned back to the outdoor unit (2) from the indoor unit (3), and is drawn into the higher stage compression mechanism (11). The refrigerant drawn into the higher stage compression mechanism (11) is compressed by the higher stage compression mechanism (11), and such a circulation operation is again repeated.

In addition, in the refrigeration apparatus (1), the controller (30) controls, according to the operation capacity required, the operation of the higher stage compression mechanism (11) and the operation of the lower stage compression mechanism (90). More specifically, if the necessary operation capacity is lower than the maximum operation capacity of the first lower stage compressor (90*a*), then only the first lower stage compressor (90*a*) is operated in the lower stage compression mechanism (90). And, with the increase in operation capacity, the second lower stage compressor (90*b*) and the third lower stage compressor (90*c*) are sequentially activated. In the case where the second lower stage compressor (90*b*) and the third lower stage compressor (90*c*) are activated, the operation capacity of the first lower stage compressor (90*a*) is decreased as required because the second lower stage compressor (90*b*) and the third lower stage compressor (90*c*) are fixed in their operation capacity. This is the same as in the higher stage compression mechanism (11).

In addition, in the present embodiment, in order that there may be no lack of refrigeration oil in each of the compressors (11*a*, 11*b*) of the higher stage compression mechanism (11), the refrigeration oil in the first lower stage compressor (90*a*) can be supplied by way of the oil return pipe (97) to the higher stage compression mechanism (11) by placing the oil return solenoid valve (98) of the oil return pipe (97) in the opened state. More specifically, the pressure of refrigerant discharged from the first lower stage compressor (90*a*) drops slightly by the time it reaches the downstream side of the oil separator (94) of the discharge pipe (85) because of the loss of pressure, even when the control valve (93) is placed in the fully opened state. That is, the pressure of the oil sump of the first lower stage compressor (90*a*), to which the one end of the oil return pipe (97) is opened, becomes slightly higher than the pressure of the downstream side of the oil separator (94) to which the other end of the oil return pipe (97) is connected. Therefore, if the oil return solenoid valve (98) is placed in the opened state when the oil level of the oil sump in the first lower stage compressor (90*a*) is higher than the opening position of the oil return pipe (97), the refrigeration oil in the oil sump of the first lower stage compressor (90*a*) is delivered by way of the oil return pipe (97) to the downstream side of the oil separator (94) in the discharge side main pipe (77). The refrigeration oil delivered to the downstream side of the oil separator (94) is drawn into the higher stage compression mechanism (11) together with the refrigerant.

However, if the operation capacity of the first lower stage compressor (90*a*) is small, then the difference in pressure between the oil sump of the first lower stage compressor (90*a*) and the downstream side of the oil separator (94) is small. This impedes the flow of refrigeration oil of the first lower stage compressor (90*a*) through the oil return pipe (97). The case where the operation capacity of the first lower stage compressor (90*a*) is being small occurs, for example, when the operation capacity of the first lower stage compressor (90*a*) is made to decrease in association with the activation of the second lower stage compressor (90*b*) and the third lower stage compressor (90*c*). The controller (30) controls the degree of opening of the control valve (93) for the execution of an oil return operation if the operation capacity of the first lower stage compressor (90*a*) falls below a predetermined value.

In the oil return operation, the degree of opening of the control valve (93) is made slightly smaller as compared to that in the fully opened state. When the degree of opening of the control valve (93) is lessened, the pressure in the casing of the first lower stage compressor (90*a*) increases and, in addition, the loss of pressure of the discharged refrigerant from the first lower stage compressor (90*a*) during its passage through the control valve (93) becomes greater. Consequently, the difference in pressure between the oil sump of the first lower stage compressor (90*a*) and the downstream side of the oil separator (94) widens, and as a result, the refrigeration oil in the first lower stage compressor (90*a*) is supplied by way of the oil return pipe (97) to the higher stage compression mechanism (11). The controller (30) is able to freely control the flowability of refrigeration oil from the first lower stage compressor (90*a*) to the higher stage compression mechanism (11) by controlling the degree of opening of the control valve (93).

Advantageous Effects of the Present Embodiment

In the present embodiment, the control valve (93) reduces the pressure of refrigerant flowing towards the oil separator (94) from the first lower stage compressor (90*a*), thereby widening the pressure difference for the feed of refrigeration oil from the first lower stage compressor (90*a*) to the higher stage compression mechanism (11). In other words, by reducing the degree of opening of the control valve (93), it becomes possible to facilitate the flow of refrigeration oil (which is likely to accumulate on the side of the lower stage compression mechanism (90) of lower pressure) from the first lower stage compressor (90*a*) to the higher stage compression mechanism (11). This facilitates the distribution of refrigeration oil to the higher stage compression mechanism (11), thereby making it possible to suppress not only the lack of refrigeration oil in the compressor (11*a*, 11*b*) of the higher stage compression mechanism (11) but also the occurrence of breakdown because of such a lack of refrigeration oil. Besides, it is possible to suppress an excessive accumulation of refrigeration oil in the first lower stage compressor (90*a*). This makes it possible to reduce the resistance to rotation caused by refrigeration oil, thus resulting in improved operation efficiency.

Furthermore, in accordance with the present embodiment, it is also possible to lubricate the compressor (11*a*, 11*b*) of the higher stage compression mechanism (11) and the compressor (90*a*, 90*b*, 90*c*) of the lower stage compression mechanism (90) with much less amounts of refrigeration oil. In this case, since the rotational resistance, caused by refrigeration oil in the compressor (11*a*, 11*b*) of the higher stage compression mechanism (11) and the compressor (90*a*, 90*b*, 90*c*) of the lower stage compression mechanism (90), is reduced, the operation efficiency of the refrigeration apparatus (1) can be enhanced.

In addition, in the present embodiment, the refrigerant, discharged from each of the second lower stage compressor (90*b*) and the third lower stage compressor (90*c*) except for the first lower stage compressor (90*a*), flows into the oil separator (94), without passing through the control valve (93). In other words, since the discharged refrigerant from each of the second lower stage compressor (90*b*) and the third lower stage compressor (90*c*) is free from any pressure loss caused by the control valve (93), this makes it possible to reduce the loss of pressure of the refrigerant in the lower stage compression mechanism (90) when compared with the case where the control valve (93) is disposed in a position located after the point at which each branched pipe (91*a*, 91*b*, 91*c*) in the discharge pipe (85) of the lower stage compression mechanism (90) joins the others. Therefore, the reduction in the efficiency of operation of the lower stage compression mechanism (90) due to the provision of the control valve (93) can be suppressed.

Additionally, in the present embodiment, by the provision of the oil feed passageway (100,101), the refrigeration oil in each compressor (90*a*, 90*b*, 90*c*) of the lower stage compression mechanism (90) is collected in the first lower stage compressor (90*a*). Therefore, much larger amounts of refrigeration oil can be fed to the higher stage compression mechanism (11), thereby making it possible to suppress not only the lack of refrigeration oil in the compressor (11*a*, 11*b*) of the higher stage compression mechanism (11) but also the occurrence of breakdown because of such a lack of refrigeration oil. Besides, it is possible to suppress an excessive accumulation of refrigeration oil in each of the second lower stage compressor (90*b*) and the third lower stage compressor (90*c*). This makes it possible to reduce, in each of the second lower stage compressor (90*b*) and the third lower stage compressor (90*c*), the resistance to rotation caused by refrigeration oil, thus resulting in improved operation efficiency.

In addition, in the present embodiment, by the provision of the controller (30) which regulates the control valve (93) so that an oil return operation is executed, the flowability of refrigeration oil from the first lower stage compressor (90*a*) to the higher stage compression mechanism (11) is controlled. Therefore, it becomes possible for the controller (30) to regulate the balance between the amount of refrigeration oil in the lower stage compression mechanism (90) and the amount of refrigeration oil in the higher stage compression mechanism (11), whereby refrigeration oil can be appropriately distributed to the compressor (90*a*, 90*b*, 90*c*) of the lower stage compression mechanism (90) as well as to the compressor (11*a*, 11*b*) of the higher stage compression mechanism (11).

Additionally, in the present embodiment, the controller (30) enables the execution of an oil return operation, when the operation capacity of the first lower stage compressor (90*a*) becomes decreased thereby impeding the flow of refrigeration oil into the higher stage compression mechanism (11) from the first lower stage compressor (90*a*). That is, regardless of the operation capacity of the first lower stage compressor (90*a*), refrigeration oil can be stably supplied to the higher stage compression mechanism (11) from the first lower stage compressor (90*a*). Therefore, it becomes possible to not only suppress the lack of refrigeration oil in the higher stage compression mechanism (11) to a further extent but also prevent refrigeration oil from excessively accumulating in the first lower stage compressor (90*a*).

Another Embodiment

With respect to the foregoing embodiment, the present invention may be configured as follows.

Figure 2:
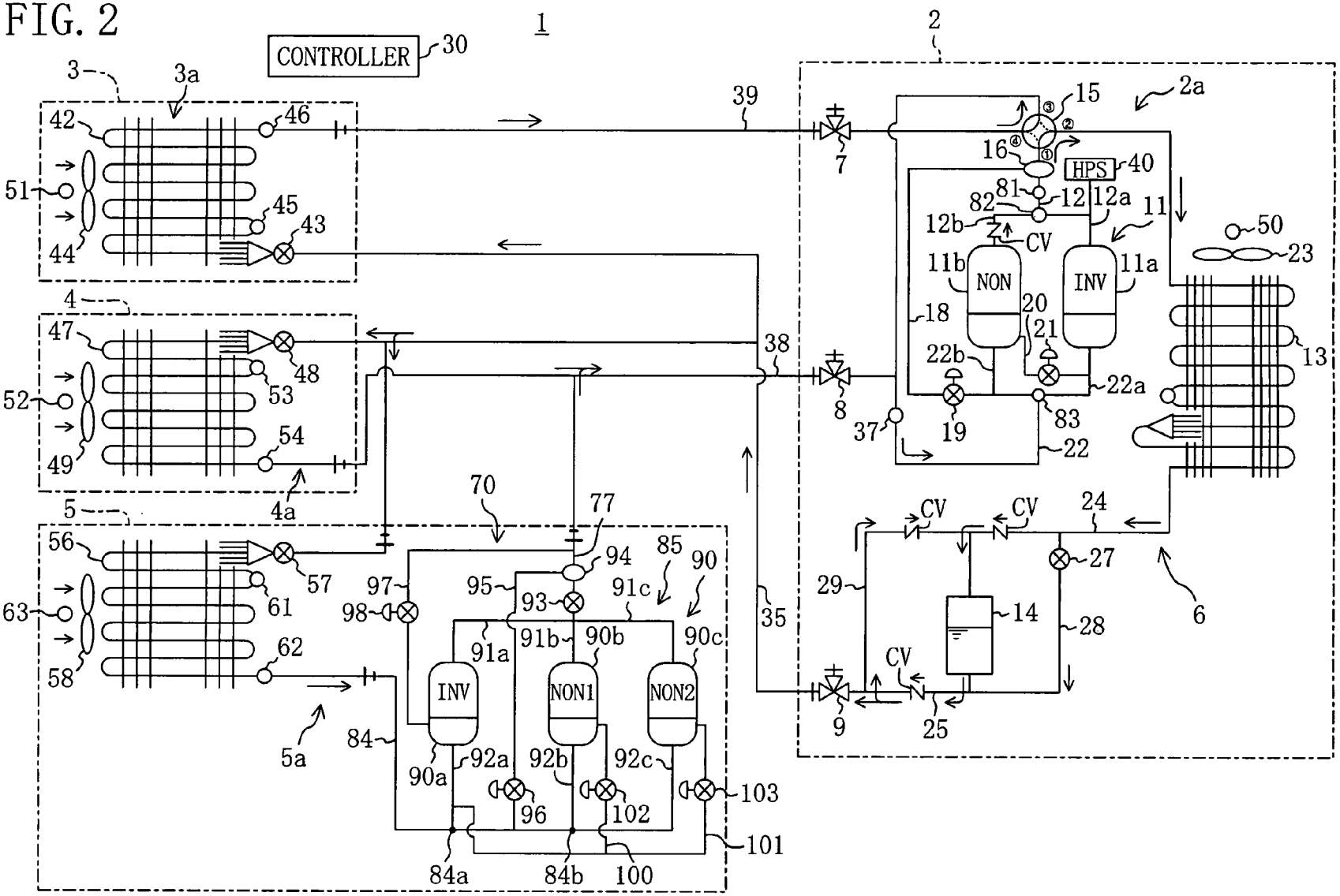
FIG. 2 is a schematic block diagram of a refrigeration apparatus according to another embodiment of the present invention.

With respect to the present embodiment, the pressure reducing means (93) may be disposed upstream of the oil separator (94) in the discharge side main pipe (77), as shown in FIG. 2.

In addition, with respect to the present embodiment, the first lower stage compressor (90*a*) may be of the operation-capacity fixed type.

Additionally, with respect to the present embodiment, in the lower stage compression mechanism (90), the compressors (90*b*, 90*c*) other than the first lower stage compressor (90*a*) may be of the operation-capacity variable type.

In addition, with respect to the present embodiment, the oil feed pipe (100,101) may not be provided. In this case, preferably, the refrigeration oil in the oil separator (94) can selectively be returned back to any one of the first lower stage compressor (90*a*), the second lower stage compressor (90*b*), and the third lower stage compressor (90*c*).

It should be noted that the above-described embodiments are essentially preferable exemplifications which are not intended in any sense to limit the scope of the present invention, its application, or its application range.

Industrial Applicability

As has been described above, the present invention finds useful application in a refrigeration apparatus intended for installation in a convenience store, a supermarket et cetera and configured such that a lower stage compression mechanism and a higher stage compression mechanism are connected together in series to perform a two-stage compression refrigeration cycle.

What is claimed is:

1. A refrigeration apparatus, comprising: a refrigerant circuit comprising a higher stage compression mechanism formed of one or more compressors and a lower stage compression mechanism formed of one or more compressors, the higher stage compression mechanism and the lower stage compression mechanism being connected together in series to perform a two-stage compression refrigeration cycle, and an oil separator, disposed in a discharge pipe of the lower stage compression mechanism in the refrigerant circuit, for separating refrigeration oil from refrigerant discharged from the lower stage compression mechanism, wherein the refrigeration apparatus includes an oil return passageway, the oil return passageway extending from a compressor, the compressor constitutes the lower stage compression mechanism for connection to a downstream side of the oil separator whereby refrigeration oil accumulated in the compressor can be supplied to the higher stage compression mechanism, wherein, in the oil return compressor as a compressor to which the oil return passageway is connected, a discharge pressure space filled with refrigerant after compression is formed in a casing thereof, and the oil return passageway opens into an oil sump in the discharge pressure space, and wherein pressure reducing means for reducing the pressure of refrigerant flowing towards the oil separator from the oil return compressor is disposed between the oil return compressor and the oil separator in the discharge pipe of the lower stage compression mechanism.

2. The refrigeration apparatus of claim 1, wherein the lower stage compression mechanism is formed of a plurality of compressors connected in parallel with one another, and wherein the pressure reducing means is disposed in a branched pipe of the discharge pipe of the lower stage compression mechanism, the branched pipe being connected to the oil return compressor.

3. The refrigeration apparatus of claim 2, wherein the lower stage compression mechanism is provided with an oil feed passageway through which to supply to a suction side of the oil return compressor refrigeration oil accumulated in the regular compressors other than the oil return compressor.

4. The refrigeration apparatus of any one of claims 1 through 3, wherein the pressure reducing means is formed by a control valve with a controllable degree of opening, and wherein control means is provided which enables, by control that reduces the degree of opening of the control valve to thereby widen the difference in pressure between the discharge pressure space of the oil return compressor and the downstream side of the oil separator, the execution of an oil return operation in which refrigeration oil accumulated in the oil sump of the discharge pressure space is fed into the higher stage compression mechanism by way of the oil return passageway.

5. The refrigeration apparatus of claim 4, wherein the oil return compressor is configured to be variable in operation capacity, and wherein the control means is so configured as to enable the execution of the oil return operation if the operation capacity of the oil return compressor falls below a predefined value.

* * * * *